US008269584B1

(12) United States Patent
Ku et al.

(10) Patent No.: US 8,269,584 B1
(45) Date of Patent: Sep. 18, 2012

(54) INCORRECT-CIRCUIT DEACTIVATION DEVICE OF MAGNETIC GFCI OUTLET

(75) Inventors: Ying-Ming Ku, Taoyuan (TW); Chun-Chieh Chen, Taoyuan (TW); Yun-Chung Yeh, Taoyuan (TW)

(73) Assignee: YFC-Boneagle Electric Co, Ltd., Taoyuan (TW)

( * ) Notice: Subject to any disclaimer, the term of this patent is extended or adjusted under 35 U.S.C. 154(b) by 0 days.

(21) Appl. No.: 13/527,270

(22) Filed: Jun. 19, 2012

Related U.S. Application Data

(63) Continuation of application No. 12/876,278, filed on Sep. 7, 2010, now Pat. No. 8,222,978.

(51) Int. Cl.

| | |
|---|---|
| ***H01H 75/00*** | (2006.01) |
| ***H01H 73/12*** | (2006.01) |
| ***H01H 73/00*** | (2006.01) |
| ***H01H 83/06*** | (2006.01) |

(52) U.S. Cl. ..... 335/18; 335/6; 335/177; 335/179; 335/180; 361/42

(58) Field of Classification Search ..... 335/18, 335/6, 177–183; 361/42–50
See application file for complete search history.

(56) References Cited

U.S. PATENT DOCUMENTS

| | | | | |
|---|---|---|---|---|
| 7,170,375 | B2 * | 1/2007 | Chen et al. | 335/177 |
| 7,498,909 | B2 * | 3/2009 | Zhang et al. | 335/18 |
| 7,965,161 | B2 * | 6/2011 | Roche | 335/229 |
| 2003/0016101 | A1 * | 1/2003 | Germain et al. | 335/6 |
| 2004/0070897 | A1 * | 4/2004 | Wu et al. | 361/42 |
| 2011/0169593 | A1 * | 7/2011 | Hu et al. | 335/174 |

* cited by examiner

*Primary Examiner* — Mohamad Musleh
(74) *Attorney, Agent, or Firm* — Chun-Ming Shih; HDLS IPR Services

(57) ABSTRACT

An incorrect-circuit deactivation device of a magnetic GFCI outlet includes an electromagnetic coil seat, a magneto-conductive core driven by the electromagnetic coil seat to displace, and two magnetic elements located on both sides of the magneto-conductive core. The magneto-conductive core is connected to a first electrical conductive end. The first electrical conductive end is positioned to face a second electrical conductive end. Electric power is supplied when the first electrical conductive end is brought into contact with the second electrical conductive end. The electromagnetic coil seat senses a reverse current to make the magneto-conductive core to displace toward one of the magnetic elements when there is a ground fault, thereby departing the first electrical conductive end from the second electrical conductive end to cut off the electric current.

2 Claims, 8 Drawing Sheets

INCORRECT-CIRCUIT DEACTIVATION DEVICE OF MAGNETIC GFCI OUTLET

RELATED APPLICATIONS

This application is a continuous application of U.S. patent application Ser. No. 12/876,278, filed on Sep. 7, 2010 now U.S. Pat. No. 8,222,978.

BACKGROUND OF THE INVENTION

1. Field of the Invention

The present invention relates to an outlet, in particular to an incorrect-circuit deactivation device of a GFCI outlet for detecting whether an electric circuit is correctly connected.

2. Description of Prior Art

GFCI is the abbreviation of a ground-fault circuit interrupter, which is widely used in households for effectively protecting people from suffering a current leakage or electric shock, so that it has been required to use the GFCI outlets in some European and American countries. For example, in North America, it has been required to use at least five GFCI outlets in every household, especially at bathrooms, kitchen or other places where may get wet easily or may be plugged by several electric appliances. In the United States, the National Electrical Code (NEC) requires that every GFCI outlet should be provided with a test button and a reset button on its surface. The test button is used to test whether the GFCI outlet is operating normally or not. The reset button is used to activate the electric power of the GFCI outlet and to detect whether the electric current is flowing normally for safety concern. Furthermore, the GFCI outlet is required to have a deactivation function when there is an incorrect circuit. With this arrangement, when there is an incorrect circuit (such as a reverse connection of circuit), the electric power will be cut off, thereby protecting a user from suffering an electric shock.

SUMMARY OF THE INVENTION

The present invention is to provide an incorrect-circuit deactivation device of a magnetic GFCI outlet, in which an electromagnetic coil seat is used to generate a forward current and a reverse current to thereby control a leftward displacement and a rightward displacement of a magneto-conductive core respectively. The magneto-conductive core can be magnetically attracted by two magnetic elements. If there is a ground fault such as a current leakage, the magneto-conductive core moves reversely to be magnetically attracted by one of the magnetic element, thereby cutting off the circuit in the outlet (i.e. cutting off the electric power) to achieve a desired deactivation function.

To this end, the present invention provides an incorrect-circuit deactivation device of a magnetic GFCI outlet, including:

an electromagnetic coil seat having a through-hole;

a magneto-conductive core movably disposed in the through-hole, the magneto-conductive core displacing in the through-hole based on a flowing direction of an electric current generated by the electromagnetic coil seat; and two magnetic elements located on both sides of the magneto-conductive core respectively, the magneto-conductive core being magnetically attracted by any one of the magnetic elements toward which the magneto-conductive core is displacing;

wherein the magneto-conductive core is connected to a first electrical conductive end, the first electrical conductive end is positioned to face a second electrical conductive end, electric power is supplied when the first electrical conductive end is brought into contact with the second electrical conductive end; the electromagnetic coil seat senses a reverse current to make the magneto-conductive core to displace toward one of the magnetic elements when there is a ground fault, thereby departing the first electrical conductive end from the second electrical conductive end to cut off the electric current.

DETAILED DESCRIPTION OF THE INVENTION

The detailed description and technical contents of the present invention will become apparent with the following detailed description accompanied with related drawings. It is noteworthy to point out that the drawings is provided for the illustration purpose only, but not intended for limiting the scope of the present invention.

Figure 1:
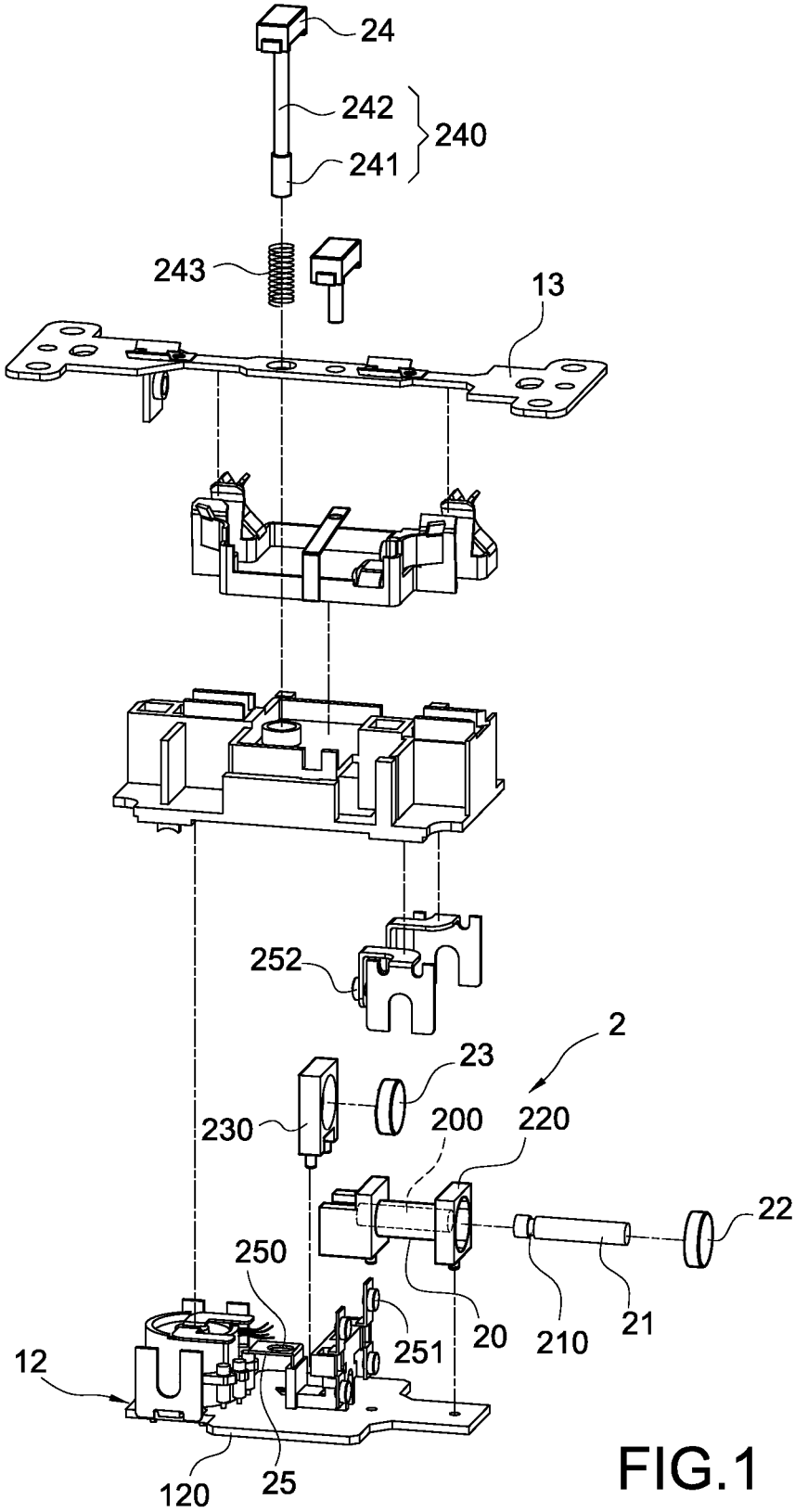
FIG. 1 is an exploded perspective view showing the internal structure of the present invention.
Figure 2:
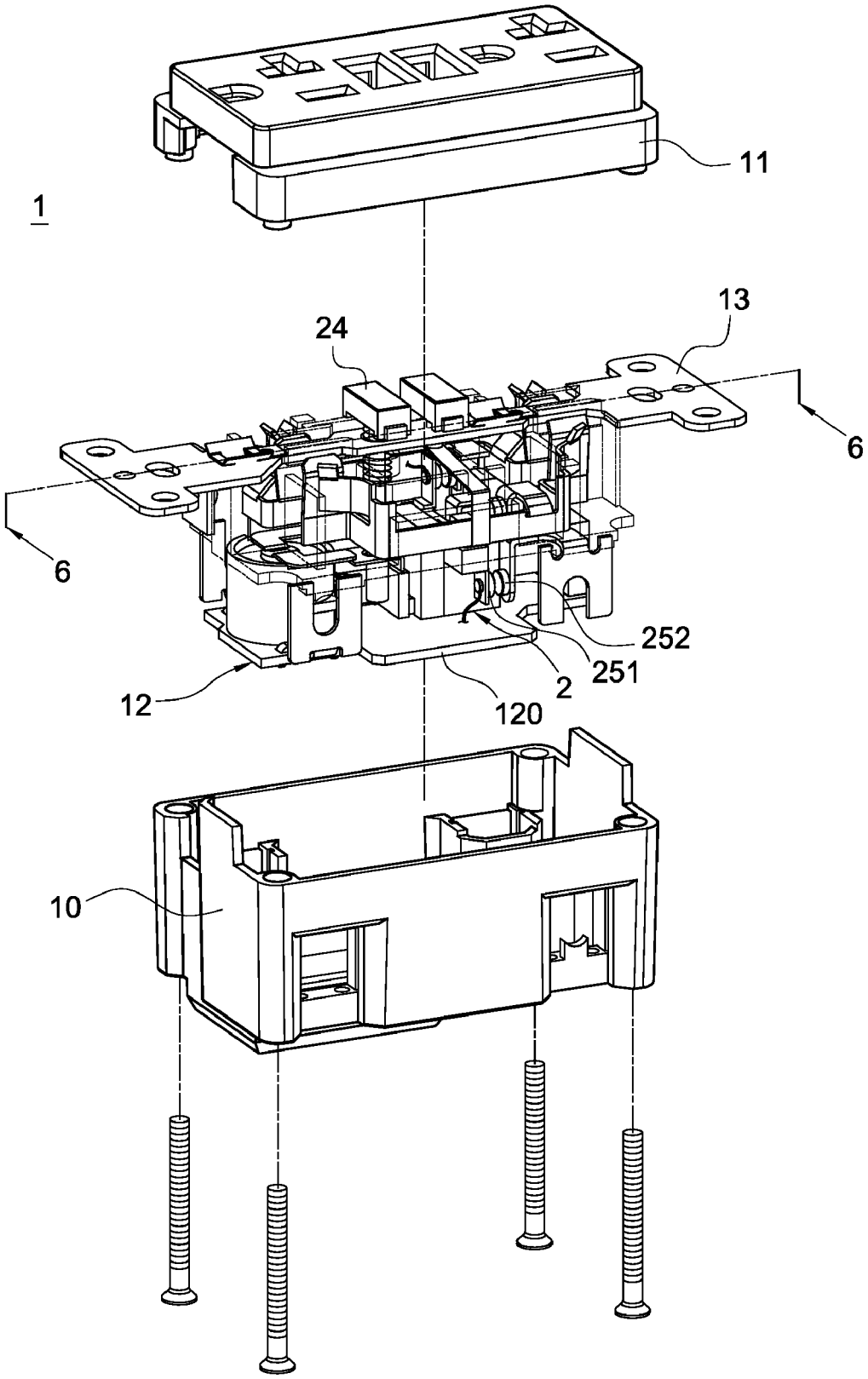
FIG. 2 is an exploded perspective view of the present invention.
Figure 3:
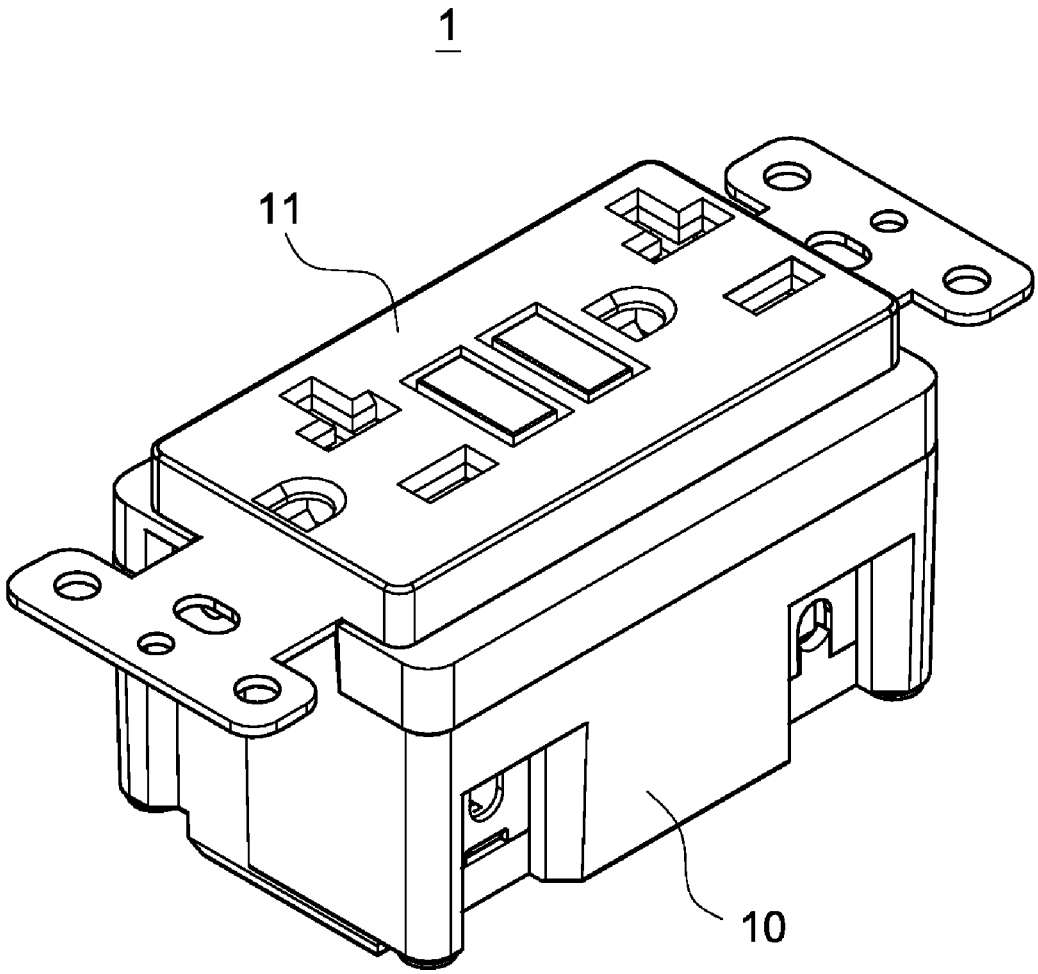
FIG. 3 is an assembled perspective view of the present invention.

FIG. 1 is an exploded perspective view showing the internal structure of the present invention, FIG. 2 is an exploded perspective view of the present invention, and FIG. 3 is an assembled perspective view of the present invention. The present invention provides an incorrect-circuit deactivation device of a magnetic GFCI outlet, which is provided in a housing 1 of a GFCI outlet. The housing 1 includes a casing base 10 and a cover plate 11. The deactivation device 2 is disposed in the casing base 10, and then the cover plate 11 covers the casing base 10 to form the GFCI outlet as shown in FIG. 3. The deactivation device 2 includes an electromagnetic coil seat 20, a magneto-conductive core 21 and two magnetic elements 22, 23.

Figure 5:
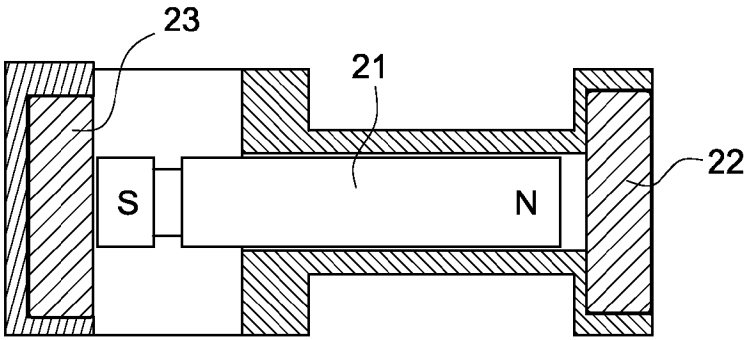
FIG. 5 is a schematic view of the present invention showing that the magneto-conductive core is magnetically attracted by the other magnetic element.
Figure 4:
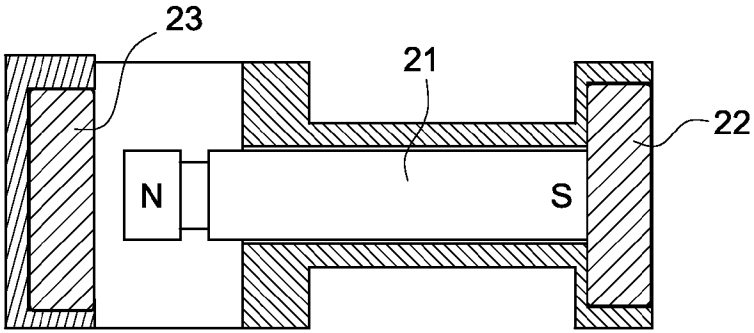
FIG. 4 is a schematic view of the present invention showing that the magneto-conductive core is magnetically attracted by one magnetic element.

The electromagnetic coil seat 20 is installed on a circuit assembly 12 inside the GFCI outlet and has a through-hole 200 for allowing the magneto-conductive core 21 to be movably disposed therein. The two magnetic elements 22, 23 are positioned outside both ends of the through-hole 200. When the electromagnetic coil seat 20 is supplied with electricity to generate magnetic poles, the flowing direction of an electric current generated by the electromagnetic coil seat 20 is used to control the left displacement or a right displacement of the magneto-conductive core 21 in the through-hole 200 (as shown in FIGS. 4 and 5). In the present embodiment, the two magnetic elements 22, 23 are fixed onto a circuit board 120 of the circuit assembly 12 through magnetic stands 220, 230 respectively. The electromagnetic coil seat 20 is also fixed onto the circuit board 120.

The magneto-conductive core 21 is connected to a first electrical conductive end 251. The first electrical conductive end 251 is positioned to face a second electrical conductive end 252.

Figure 6:
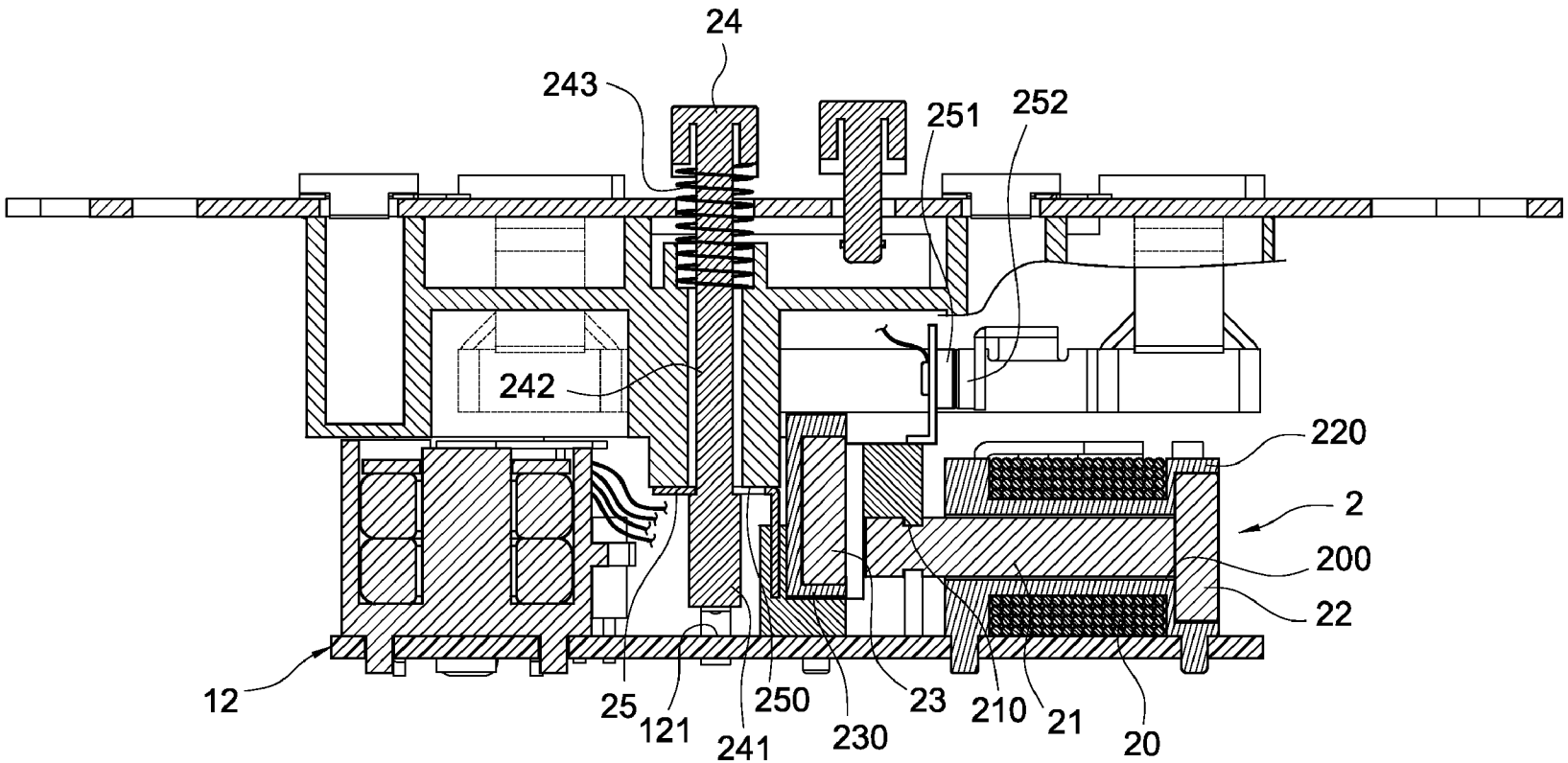
FIG. 6 is a cross-sectional view taken along the line 4-4 in FIG. 2.
Figure 7:
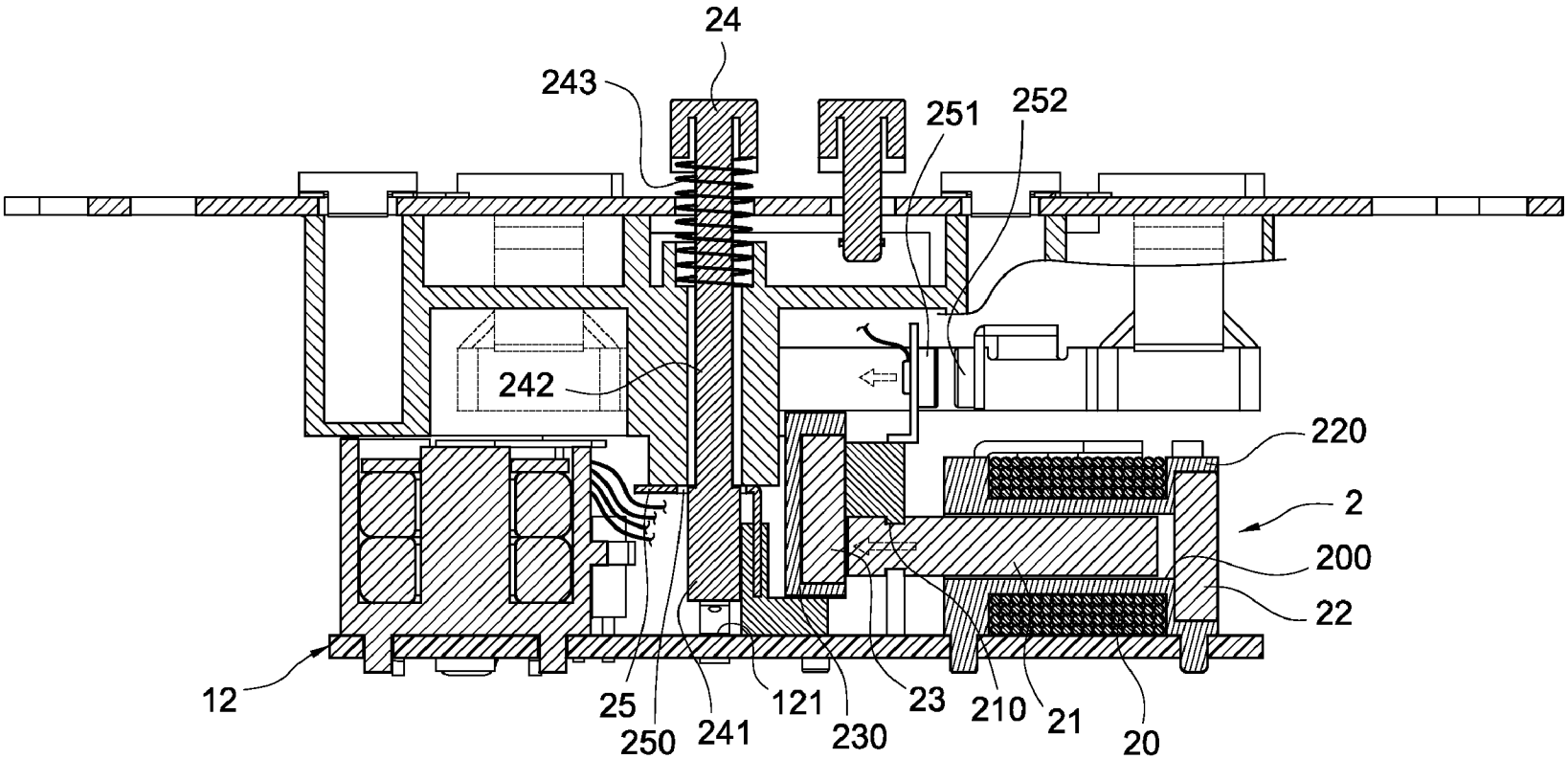
FIG. 7 is a schematic view (I) showing the action of FIG. 4.

As shown in FIG. 6, when the first electrical conductive end 251 is brought into contact with the second electrical conductive end 252, the GFCI outlet is activated to supply electricity normally. On the contrary, as shown in FIG. 7, when the first electrical conductive end 251 is not brought into contact with the second electrical conductive end 252, the GFCI outlet is deactivated to be unable to supply electricity. Thus, when the magneto-conductive core 21 displaces leftwards or rightwards in the through-hole 200, the displacement of the magneto-conductive core 21 causes the corresponding movement of the first electrical conductive end 251. As a result, the movement of the first electrical conductive end 251 makes it to contact with or depart from the second electrical conductive end 252. In the present embodiment, one end of the magneto-conductive core 21 is provided with an annular groove 210 for allowing the first electrical conductive end 251 to be engaged with.

As shown in FIGS. 6 and 7. When there is a ground fault (such as a current leakage) in the GFCI outlet, the circuit assembly 12 provides an instantaneous reverse current to the electromagnetic coil seat 20, so that the magneto-conductive core 21 repels the magnetic element 22. As a result, the magneto-conductive core 21 displaces toward the other magnetic element 23 to make the first electrical conductive end 251 to depart from the second electrical conductive end 252, thereby cutting off the electric current and achieving a deactivation function upon an incorrect circuit.

Further, the present invention also cooperates with a reset button 24 to make the first electrical conductive end 251 to be brought into contact with the second electrical conductive end 252 again for re-supplying electricity. The reset button 24 is the reset button originally provided on the GFCI outlet. The lower end of the reset button 24 is connected to a rod 240. The rod 240 has a first section 241 of a larger diameter and a second section 241 of a smaller diameter. The second section 242 is movably disposed in a restricting piece 25 having a locking hole 250. The distal end of the rod 240 abuts against a pressing switch 121 provided on the circuit board 120 of the circuit assembly 12. The pressing switch 121 allows the circuit assembly 12 to provide a forward current to the electromagnetic coil seat 20. The restricting piece 25 is located adjacent to the magnetic element 23 and connected to the first electrical conductive end 251. The restricting piece 25 is located outside the first section 241 or the second section 241 of the rod 240 depending on the pressing of the reset button 24. When the magneto-conductive core 21 displaces leftwards or rightwards in the through-hole 200, the restricting piece 25 and the first electrical conductive end 251 also move together with the magneto-conductive core 21, thereby restricting the reset button 24 from popping out (later described). In the present embodiment, the reset button 24 has an elastic element 243 abutting against a beam 13 of the housing 1. The rod 240 extends into the housing 1 with the bottom end of the rod 240 being located adjacent to the circuit board 120 of the circuit assembly 12 (as shown in FIG. 6). The restricting piece 25 is also located on the circuit board 120 outside the magnetic element 23.

Figure 8:
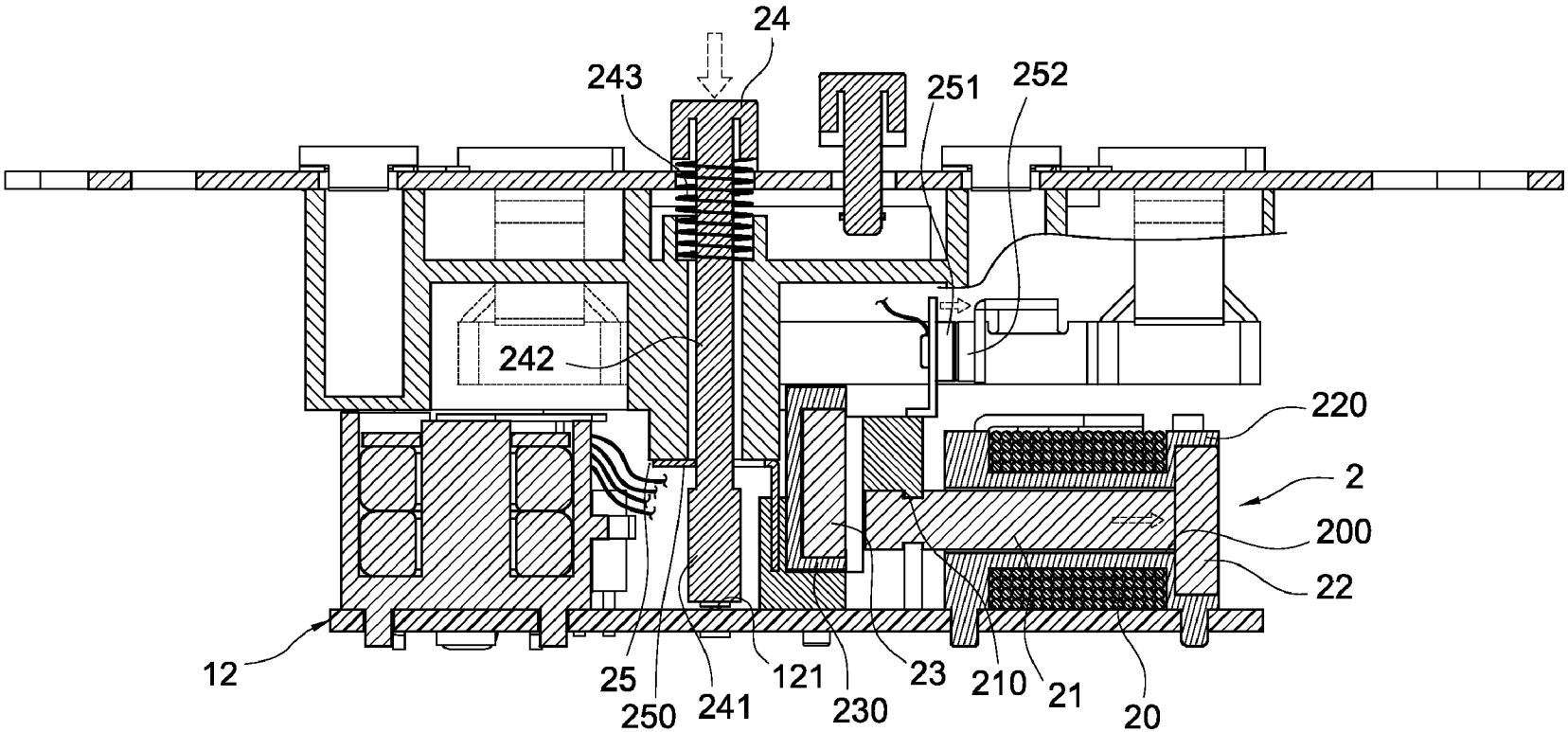
FIG. 8 is a schematic view (II) showing the action of FIG. 4.
Figure 9:
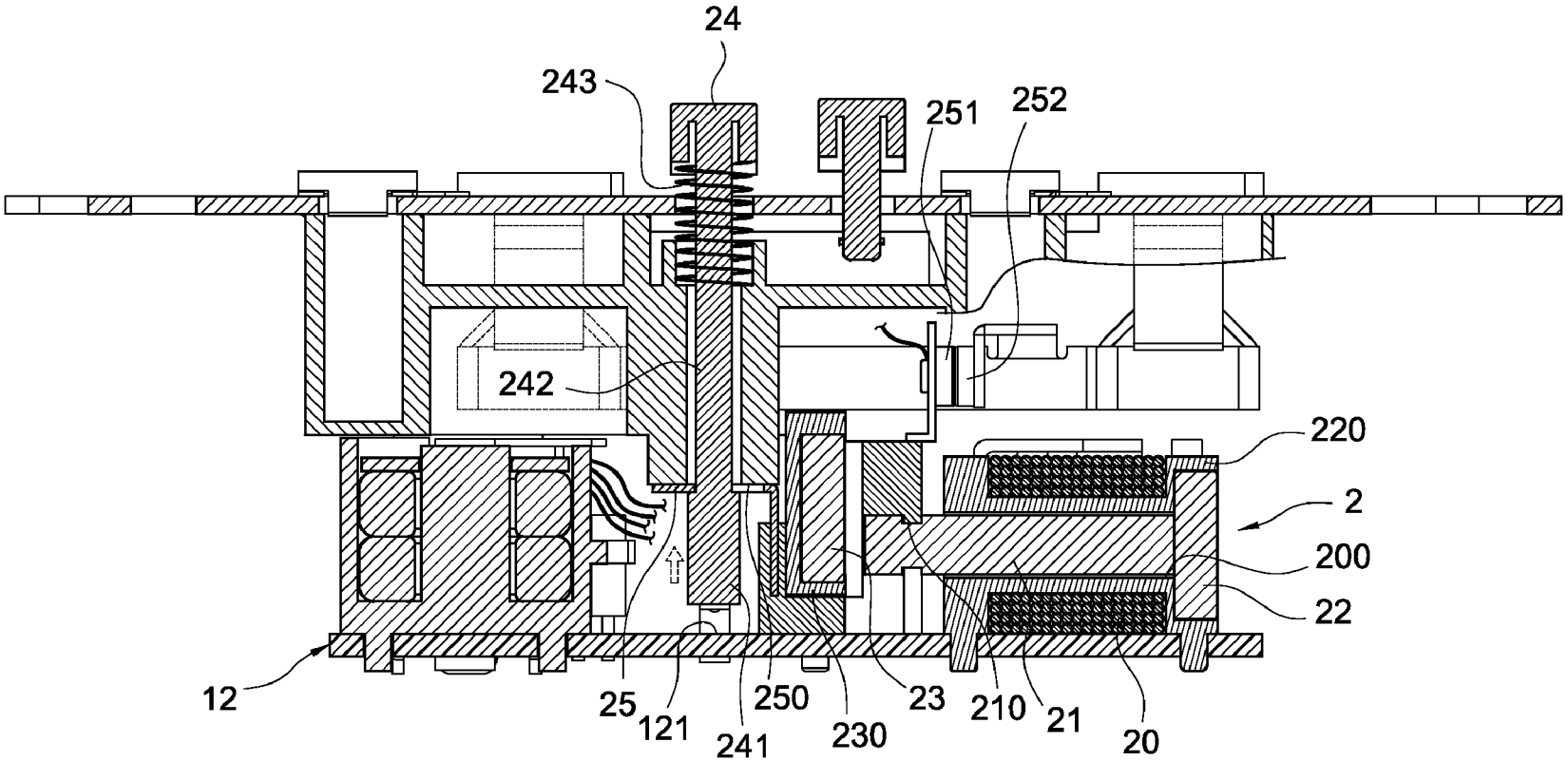
FIG. 9 is a schematic view (III) showing the action of FIG. 4.

As shown in FIGS. 7 and 8, when the user intends to re-activate the GFCI outlet from the aforesaid deactivation state, the user can press the reset button 24. In this way, the pressing switch 121 is triggered to make the circuit assembly 12 to provide a forward current to the electromagnetic coil seat 20. As a result, the magneto-conductive core 21 repels the magnetic element 23 to displace toward the other magnetic element 22. Thus, the magneto-conductive core 21 is magnetically attracted by the magnetic element 22 and fixed thereto, thereby causing the first electrical conductive end 251 to be brought into contact with the second electrical conductive end 252 again. When the user releases the reset button 23, the reset button 24 will pop out due to the elastic element 243, so that the rod 240 departs from the pressing switch 121. At this time, as shown in FIG. 8, the second section 242 of a small diameter is located in the locking hole 250 after the reset button 24 is pressed, and the restricting piece 25 moves together with the magneto-conductive core 21 in such a manner that the locking hole 250 is engaged with the second section 242. Thus, the reset button 24 cannot pop out because the first section 241 abuts against the outer edge of the locking hole 250 (as shown in FIG. 9). Thus, the user can recognize that the GFCI outlet is still operating normally for supply electricity.

Therefore, with the above structure, the incorrect-circuit deactivation device of a magnetic GFCI outlet according to the present invention is obtained.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. An incorrect-circuit deactivation device of a magnetic GFCI outlet, comprising:

an electromagnetic coil seat having a first magnetic stand formed at one side and a through-hole connected to the first magnetic stand;

a second magnetic stand disposed at a side of the electromagnetic coil seat opposite to the first magnetic stand;

a magneto-conductive core with one end provided with an annular groove, movably disposed in the through-hole, the magneto-conductive core displacing in the through-hole based on a flowing direction of an electric current generated in the electromagnetic coil seat; and a first and a second magnetic elements displaced in the first and the seconds magnetic stands respectively, the magneto-conductive core being magnetically attracted by and contacted with either the first or the second magnetic element;

a first electrical conductive end movable together with the magneto-conductive core by an engagement with the annular groove, wherein a second electrical conductive ends is positioned to face the first electrical conductive end, electric power is supplied when the first electrical conductive end is brought into contact with the second electrical conductive end, and the electromagnetic coil seat is supplied with a reverse current to make the magneto-conductive core to displace toward the second magnetic element when there is a ground fault, thereby departing the first electrical conductive end from the second electrical conductive end to cut off the electric current.

2. The incorrect-circuit deactivation device of a magnetic GFCI outlet according to claim 1, further including a reset button, a lower end of the reset button being connected to a rod, the rod being movably disposed on a restricting piece having a locking hole, a distal end of the rod abutting against a pressing switch, the pressing switch allowing a forward current to be supplied to the electromagnetic coil seat to thereby cause the magneto-conductive core to displace toward the other magnetic element, whereby the magneto-conductive core is magnetically attracted by the other magnetic element and fixed thereto to make the first electrical conductive end to be brought into contact with the second electrical conductive end.

* * * * *